US009709930B2

(12) United States Patent
Sahara

(10) Patent No.: US 9,709,930 B2
(45) Date of Patent: Jul. 18, 2017

(54) IMAGE FORMING APPARATUS HAVING OPENINGS AND DUCTS TO PERMIT FLOW OF AIR

(71) Applicant: CANON KABUSHIKI KAISHA, Tokyo (JP)

(72) Inventor: Hiroshi Sahara, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/082,298

(22) Filed: Mar. 28, 2016

(65) Prior Publication Data

US 2016/0291511 A1 Oct. 6, 2016

(30) Foreign Application Priority Data

Mar. 30, 2015 (JP) ..... 2015-068368

(51) Int. Cl.
*G03G 21/20* (2006.01)
*G03G 15/20* (2006.01)

(52) U.S. Cl.
CPC ..... *G03G 15/2017* (2013.01)

(58) Field of Classification Search
USPC ..... 399/91–93, 107, 110, 122
See application file for complete search history.

(56) References Cited

U.S. PATENT DOCUMENTS 7,386,247 B2 * 6/2008 Doi ..... G03G 15/2064 399/92
7,570,895 B2 8/2009 Ando et al.
7,792,448 B2 9/2010 Ando et al.
8,725,025 B2 * 5/2014 Murasaki ..... G03G 15/2017 399/92
8,938,194 B2 1/2015 Keino et al.
8,965,259 B2 2/2015 Sahara
9,014,589 B2 * 4/2015 Taguchi ..... G03G 21/206 399/92
9,081,358 B2 * 7/2015 Maeda ..... G03G 21/1685
2015/0104229 A1 4/2015 Sahara

FOREIGN PATENT DOCUMENTS

JP 2002-365946 A 12/2002
JP 2006-58695 A 3/2006
JP 2006-91253 A 4/2006
JP 2011-257670 A 12/2011
JP 2013-257410 A 12/2013

* cited by examiner

*Primary Examiner* — Hoan Tran
(74) *Attorney, Agent, or Firm* — Fitzpatrick, Cella, Harper & Scinto

(57) ABSTRACT

An image forming apparatus includes a fixing portion for fixing a toner image formed on a recording material thereon, the fixing portion including a heating member having a heat source, a pressing member cooperating with the heating member to form a nip while pressing against the heating member, and a frame containing the heating member and the pressing member; a first opening, provided in the frame, for permitting air to flow out of the frame; a second opening, provided in the frame, for permitting air to flow into the frame; and an external duct provided, outside the fixing portion, for guiding the air discharged through the first opening to the second opening. At least a part of an inner wall of the external duct is made of a metal plate, and the air introduced through the second opening is guided to the pressing member.

8 Claims, 5 Drawing Sheets

IMAGE FORMING APPARATUS HAVING OPENINGS AND DUCTS TO PERMIT FLOW OF AIR

FIELD OF THE INVENTION AND RELATED ART

The present invention relates to an image forming apparatus such as a copying machine, a printer, etc., which uses an electrophotographic technology for forming an image on recording medium.

In a case where an unfixed toner image is formed on recording medium which has absorbed a substantial amount of moisture by being left unattended in a body of humid air for a substantial length of time, and then, the unfixed toner image is thermally fixed to the recording medium in the fixing section of the image forming apparatus, the moisture in the recording medium instantly evaporates into water vapor.

There is a toner image on the image bearing surface of recording medium. Therefore, the moisture in the recording medium is prevented from evaporating from the area of the image bearing surface of the recording medium, which is covered by the toner image. Thus, the moisture in the recording medium is released from the back surface of the recording medium, that is, the surface having no toner image, by a greater amount than the toner image bearing surface. By the way, a substantial number of image forming apparatuses which are designed to be small in electrical power consumption are structured so that they do not heat their fixing section, or heat, but only by a small amount, while they are kept on standby during a period in which they are waiting for a print command.

An example of the above described image forming apparatuses is the one structured so that its fixation nip is formed between its fixation film and pressure roller. In a case of an image forming apparatus such as the one described above which is small in the amount of power consumption, even after a print command was inputted, and the temperature of the fixing section has reached fixation temperature, the pressure roller which does not have a heat source, and with which the back surface of the recording medium comes into contact, sometimes fails to be sufficiently heated. Thus, the water vapor from the recording medium condenses on the peripheral surface of the pressure roller.

As the water vapor condenses on the peripheral surface of the pressure roller, the friction between the pressure roller and fixation film reduces, and therefore, the pressure roller slips on the fixation film. As a result, the recording medium reduces in the speed with which it is circularly moved, or sometimes fails to be moved through the fixation nip. Eventually, the fixing section is jammed by the recording medium.

One of the methods for solving the above described problem is disclosed in Japanese Laid-open Patent Application No. 2002-365946. According to this application, the image forming apparatus is structured so that the water vapor which is in the adjacencies of the pressure roller is exhausted from the fixing device to ensure that the peripheral surface of the pressure roller is able to grip a sheet P of recording medium.

Another solution to the above described problem is disclosed in Japanese Laid-open Patent Application No. 2011-257670. According to this application, the image forming apparatus is structured so that the body of air in the fixing device, which contains water vapor, is exhausted, is dehumidified with the use of desiccant, and then, is reintroduced into the fixing device.

In the case of the image forming apparatus disclosed in Japanese Laid-open Patent Application No. 2002-365946, however, a fresh supply of air has to be sent to the adjacencies of the pressure roller while discharging the humid air out of the image forming apparatus. Thus, if the air in the adjacencies of the image forming apparatus is highly humid, the fresh supply of air to be sent to the adjacencies of the pressure roller is also highly humid. Thus, the image forming apparatus disclosed in Japanese Laid-open Patent Application No. 2002-365946 is ineffective from the standpoint of removing the humid air from within the fixing device.

Further, in the case of the image forming apparatus disclosed in the Japanese Laid-open Patent Application No. 2011-257670, desiccant is required. Thus, the image forming apparatus has to be devised to maintain the desiccant in performance.

SUMMARY OF THE INVENTION

Thus, the primary object of the present invention is to provide an image forming apparatus which is capable of drawing out the humid air in the fixing section, dehumidifying the humid air without using desiccant, and sending the dehumidified air back into the fixing section.

According to an aspect of the present invention, there is provided an image forming apparatus comprising a fixing portion configured to fix a toner image formed on a recording material thereon, said fixing portion including a heating member having a heat source, a pressing member cooperating with said heating member to form a nip while pressing against said heating member, and a frame containing said heating member and said pressing member; a first opening provided in said frame and configured to permit air to flow from an inside of said frame to an outside of said frame; a second opening provided in said frame and configured to permit air to flow from the outside of said frame to an inside of said frame; and an external duct provided outside said fixing portion and configured to guide the air discharged through said first opening to said second opening; wherein at least a part of an inner wall of said external duct is made of a metal plate, and the air introduced through said second opening is guided to the pressing member.

Further features of the present invention will become apparent from the following description of exemplary embodiments with reference to the attached drawings.

DESCRIPTION OF THE EMBODIMENTS

Hereinafter, the present invention is described in detail with reference to a few of the preferred embodiments of the present invention. However, the measurements, materials, and configurations of the structural components in the following embodiments of the present invention, and the positional relationship among the structural components, are modifiable according to the structure of an image forming apparatus to which the present invention is applied, and various conditions under which the present invention is applied. Thus, the following embodiments are not intended to limit the present invention in scope, unless specifically noted. By the way, a given structural component, and a section thereof, in the second embodiment and thereafter, which are the same in structure as the counterparts in the first embodiment, is given the same referential codes as that given to the counterparts so as not to repeat the same description.

Embodiment 1

Figure 1:
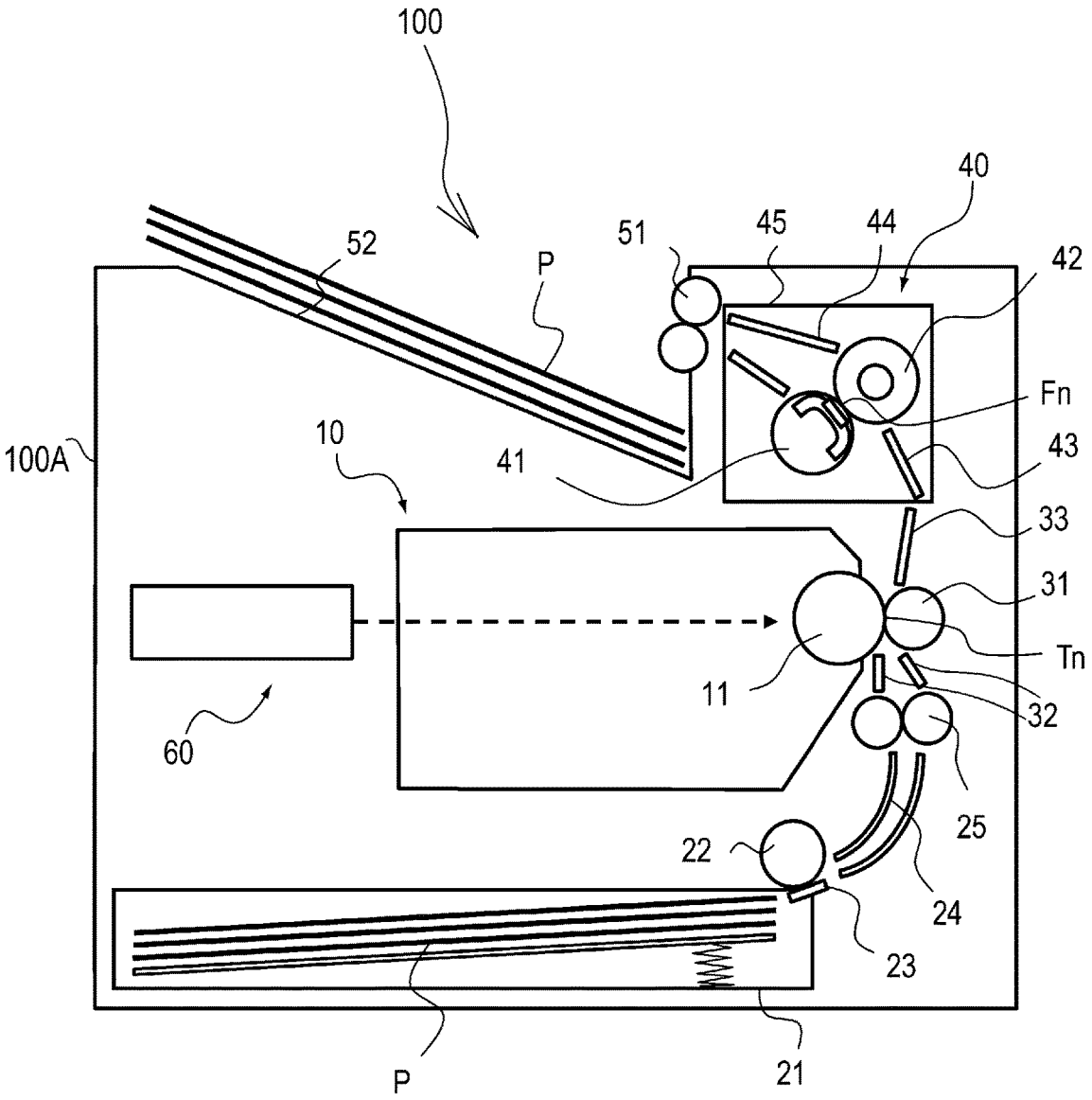
FIG. 1 is a vertical sectional view of the image forming apparatus in the first embodiment of the present invention.

FIG. 1 is a sectional view of the image forming apparatus 100 in the first of preferred embodiments of the present invention. This image forming apparatus 100 is a laser printer which employs a process cartridge. It forms an image on recording medium with the use of an electrophotographic image forming method.

Figure 2:
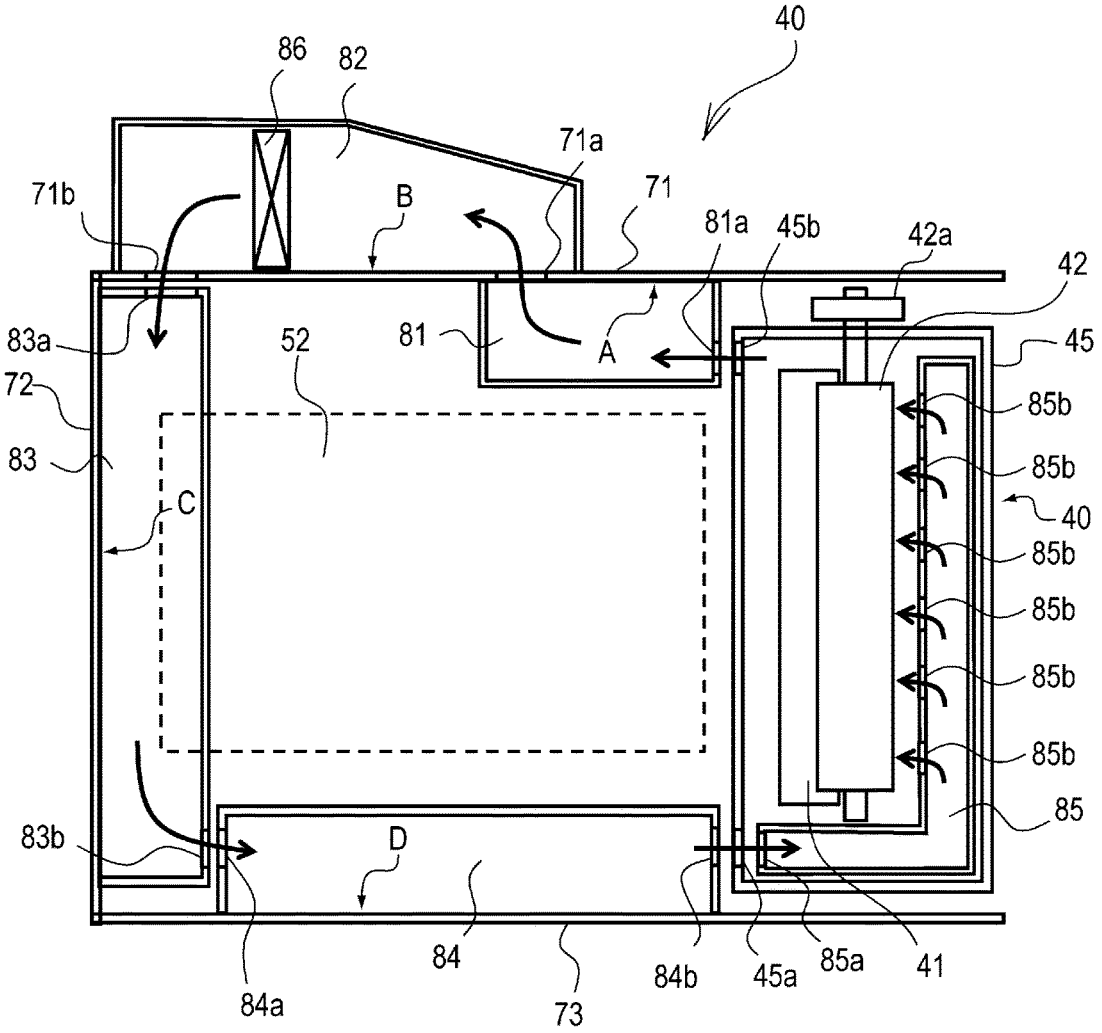
FIG. 2 is a horizontal sectional view of the image forming apparatus in the first embodiment.

The image forming apparatus 100 has a main assembly 100A, which hereafter will be referred to as apparatus main assembly 100A. The apparatus main assembly 100A has an external frame which comprises lateral plates 71, 72 and 73 (FIG. 2). The image forming apparatus 100 employs a process cartridge 10, which is installed within the apparatus main assembly 100A. The cartridge 10 internally holds a photosensitive drum 11 as an image bearing component, and multiple unshown processing means, such as a charging device, a developing device, a cleaning device, etc. The processing means are disposed in the adjacencies of the peripheral surface of the photosensitive drum 11. The image forming apparatus 100 has an optical system 60 which projects a beam of light upon the peripheral surface of the photosensitive drum 11 while modulating the beam according to the information of an image to be formed. The optical system 60 is disposed on the left side of the cartridge 10, within the apparatus main assembly 100A.

There is disposed a cassette 21 in the bottom section of the apparatus main assembly 100A. Sheets P of recording medium in the cassette 21 are fed one by one into the apparatus main assembly 100A by a combination of a sheet-feeding-conveying roller 22 and a separation pad 23, while being separated from the rest of sheets P in the cassette 21. The sheet-feeding-conveying roller 22 is activated by a print signal from an unshown host computer. As each sheet P of recording medium is fed into the apparatus main assembly 100A, it is conveyed to a pair of registration rollers 25 through a sheet conveyance guide 24. Thereafter, it is conveyed to a transfer nip Tn formed by a combination of the photosensitive drum 11 and a transfer roller 31.

Meanwhile, as the information of the image to be formed is sent to the optical system 60, a beam of light is projected upon the peripheral surface of the photosensitive drum 11 in the cartridge 10, while being modulated according to the information. As a result, an electrostatic image, which is in accordance with the information, is effected upon the peripheral surface of the photosensitive drum 11. Then, the electrostatic image is developed into a visible image (toner image, or image formed of toner) with the use of toner. The sheet P of recording medium is conveyed through the transfer nip Tn in synchronism with the progression of the formation of the toner image on the photosensitive drum 11, while such voltage that is opposite in polarity from the toner image on the photosensitive drum 11 is applied to the transfer roller 31. Thus, the toner image on the photosensitive drum 11 is transferred onto the sheet P, in the transfer nip Tn.

After the reception of the toner image by the sheet P of recording medium in the secondary transfer nip Tn, the sheet P is conveyed to a fixing device 40 through a sheet conveyance guide 33. Then, the sheet P is guided by an entrance guide 43 of the fixing device 40 to a fixation nip Fn which is formed by a combination of a fixation film 41 and a pressure roller 42. The pressure roller 42 is rotationally driven by an unshown driving force source. The pressure roller 42 is kept pressed upon the fixation film 41 with the application of a preset amount of pressure. Thus, as the pressure roller 42 is driven, it transmits driving force to the fixation film 41.

As the sheet P of recording medium is conveyed to the fixation nip Fn, it is conveyed through the fixation nip Fn by the rotational driving of the pressure roller 42 while the toner image is fixed to the sheet P by the application of a preset amount of heat, and a preset amount of pressure. After being conveyed through the fixation nip Fn, the sheet P is guided by a discharge guide 44 to a pair of discharge rollers 51. Then, it is discharged by the pair of discharge rollers 51 into a delivery tray 52, which is a part of the top wall (plate) of the external shell (frame) of the apparatus main assembly 100A.

FIG. 2 is a horizontal sectional view of the image forming apparatus 100. For the sake of convenience, the aforementioned discharge guide 44 and pair of discharge rollers 51 are not illustrated in FIG. 2. The fixing device 40, which is the fixing section of the image forming apparatus 100, has: the fixation film 41, as a heating component, which internally holds a heat source; and the pressure roller 42, as a pressure applying component, which presses upon the fixation roller while forming a nip in cooperation with the fixation film 41. Further, the fixing device 40 has also a frame 45 which surrounds the fixation film 41 and pressure roller 42. These components are fixed to the external frame of the apparatus main assembly 100A, which has the lateral plates 71, 72 and 73, with the use of unshown fixing components. After the toner image is transferred from the peripheral surface of the photosensitive drum 11 onto the sheet P of recording medium, the fixing device 40 fixes the toner image to the sheet P.

One of the lengthwise ends of the rotational axle of the pressure roller 42 is fitted with a driver gear 42*a* through which driving force is transmitted to the pressure roller 42. One of the lengthwise ends of the frame 45 is provided with an exhaust opening 45*b*, whereas the other end is provided with an intake opening 45*a*. That is, one of the lengthwise ends of the fixing device 40 is provided with the exhaust opening 45*b*, whereas the other end is provided with the intake opening 45*a*.

The exhaust opening 45*b*, which hereafter may be referred to as the first opening, is a part of the frame 45. It is an opening through which the air in the adjacencies of the fixation film 41 and pressure roller 42 is exhausted out of the frame 45. The intake opening 45*a*, which hereafter may be referred to as the second opening, is also a part of the frame 45. It is an opening through which ambient air is allowed to enter the frame 45, and also, through which the ambient air is guided to the pressure roller 42. The image forming apparatus 100 in this embodiment has the first, second, third, and fourth ducts 81, 82, 83 and 84, respectively, which are external ducts of the fixing section, as will be described later in detail.

The image forming apparatus 100 is structured so that the lateral plates 71, 72, and 73 (metallic plates) of the apparatus main assembly 100A double as parts of the first, second, third, and fourth ducts 81, 82, 83 and 84, respectively. The first intake opening 81*a* of the first duct 81, which is the first opening, that is, the most upstream intake opening, of a combination of the first, second, third, and fourth ducts, 81, 82, 83 and 84, in terms of the airflow, guides into the first duct 81, the air which comes out of the exhaust opening 45*b*, whereas the fourth exhaust opening 84*b*, which is the other end of the combination of the four air ducts, guides the air in the fourth duct 84, to the intake opening 45*a*.

The first duct 81 is in the adjacencies of the exhaust opening 45*b*. It is attached to the lateral plate 71 of the apparatus main assembly 100A. It is disposed in such a manner that the first intake opening 81*a* faces the exhaust opening 45*b*.

The lateral plate 71 of the apparatus main assembly 100A is made of a sheet of metallic substance. Its surface A is exposed in the first duct 81. The second duct 82 is disposed next to the first duct 81 in such a manner that the body of air in the first duct 81 and the body of air in the second duct 82 are in connection to each other through a hole 71*a*, with which the lateral plate 71 of the apparatus main assembly 100A is provided. The second duct 82 also is attached to the lateral plate 71 of the apparatus main assembly 100A. The surface B of the lateral plate 71 is exposed in the second duct 82. Further, there is disposed an air circulation fan 86 in the second duct 82.

The air circulation fan 86, which hereafter may be referred to as the first fan, draws out the air in the fixing device 40 through the exhaust opening 45*b*, and then, sends the air back into fixing device 40 through the first, second, third, and fourth ducts 81, 82, 83 and 84. By the way, the air circulation fan 86 may be disposed in the first, third, or fourth ducts 81, 83 and 84, respectively.

Moreover, the third duct 83 is disposed next to the second 82 in such a manner that the body of air in the second duct 82 and the body of air in the third duct 83 are in connection to each other through a hole 71*b*, with which the lateral plate 72 of the apparatus main assembly 100A is provided. Further, the third exhaust opening 83*b* faces the fourth intake opening 84*a*, with which the fourth duct 84 is provided. The third duct 83 is attached to the lateral plate 72 of the apparatus main assembly 100A. The inward surface C of the lateral plate 72 is exposed in the third duct 83.

The fourth duct 84 is attached to the lateral plate 73 of the apparatus main assembly 100A in such an attitude that the fourth intake opening 84*a* faces the third exhaust opening 83*b*. The fourth exhaust opening 84*b* faces the intake opening 45*a*. The body of air in the third duct 83 is in connection to the body of air in the fourth duct 84. Further, the inward surface D of the lateral plate 73 of the apparatus main assembly 100A is exposed in the fourth duct 84.

The fixing device 40 is provided with an internal duct 85 for blowing air at the pressure roller 42, across the entire range of the peripheral surface of the pressure roller 42 in terms of the lengthwise direction of the pressure roller 42. This internal duct 85 of the fixing device 40 makes up the fifth duct of the image forming apparatus 100. As air is blown into the fifth air duct 85, the air is blown at the pressure roller 42, across the entire range of the pressure roller 42. The fifth duct 85 is disposed within the frame 45. It is shaped like a letter L as shown in FIG. 2. However, it is not mandatory that the fifth duct 85 is shaped like a letter L. The fifth duct 85 has the fifth intake opening 85*a* and multiple exhaust openings 85*b*. The fifth intake opening 85*a* faces the intake opening 45*a*. The fifth exhaust openings 85*b* are distributed in the lengthwise direction of the pressure roller 42, and face the peripheral surface of the pressure roller 42.

Next, the airflow through the combination of the multiple ducts is described. As an unfixed toner image is fixed to a sheet P of moist recording medium, a substantial amount of hot water vapor is released into the air in the fixing device 40. Thus, the body of air in the fixing device 40 becomes hot and humid. This body of hot and humid air is drawn into the first duct 81 by the operation of the air circulation fan 86, through the exhaust opening 45*b*. As the body of hot and humid air is drawn into the first duct 81, a part of the body of hot and humid air comes into contact with the surface A of the lateral plate 71 of the apparatus main assembly 100A.

Since the lateral plate 71 of the apparatus main assembly 100A is lower in temperature than the body of air which is being drawn into the first duct 81, a part of the water vapor in the body of air condenses, reducing thereby the body of air in water vapor content. Then, the body of air is drawn into the second duct 82, and a part of the body of air comes into contact with the surface B. Thus, a part of the water vapor in the body of air condenses as it did when the body of air came into contact with the surface A. Thus, the body of air is further reduced in water vapor content. Thereafter, the body of air is drawn into the third duct 83, coming into contact with the surface C, being thereby further reduced in water vapor content, and then, into the fourth duct 84, coming into contact with the surface D, being thereby further reduced in water vapor content.

Thus, by the time the body of air is blown into the fixing device 40 through the intake opening 45*a*, it will have been significantly reduced in water vapor content. In other words, the body of air which is blown into the fixing device 40 is significantly smaller in moisture content, that is, significantly drier, than when the body of air was drawn out of the fixing device 40. As the body of air drawn out of the fixing device 40 is repeatedly made to come into contact with the lateral plates of the apparatus main assembly 100A, it is reduced in water vapor content (moisture content) through condensation. Further, by the time the body of air drawn out of the fixing device 40 is returned to the fixing device 40, it is not as high in temperature as when it is drawn out of the fixing device 40. However, it is sufficiently high in temperature to prevent the water vapor therein from condensing on the surface of the pressure roller 42.

To iterate, as an unfixed toner image is fixed to a sheet P of moist recording medium, a body of air which contains a substantial amount of hot water vapor occurs in the fixing device 40. This body of air is drawn into ducts in which a piece of metallic plate is exposed to make the water vapor in the body of air to condense. Thus, the body of air drawn out of the fixing device 40 is significantly reduced in water vapor content. Thus, this embodiment can eliminate the need for desiccant and/or a desiccating device, being thereby able to contribute to reduce an image forming apparatus in size and cost.

Further, the body of air draw out of the fixing device 40 is dehumidified and then, is blown back onto the pressure roller 42 of the fixing device 40 while remaining sufficiently high in temperature. Thus, the body of air which is blown at the pressure roller 42 is unlikely to be affected by the ambience of the image forming apparatus 100. Therefore, it is possible to prevent the problem that the fixing device 40 is reduced in performance by the overcooling of the pressure roller 42. Further, it is possible to prevent the problem that water vapor condensation occurs on the peripheral surface of the pressure roller 42. Therefore, it is possible to prevent the pressure roller 42 from slipping on the fixation film 41. Therefore, it is possible to realize an image forming apparatus which does not suffer from paper jam attributable to the slippage between the pressure roller and fixation film, and therefore, can output a high quality image.

Embodiment 2

Figure 3:
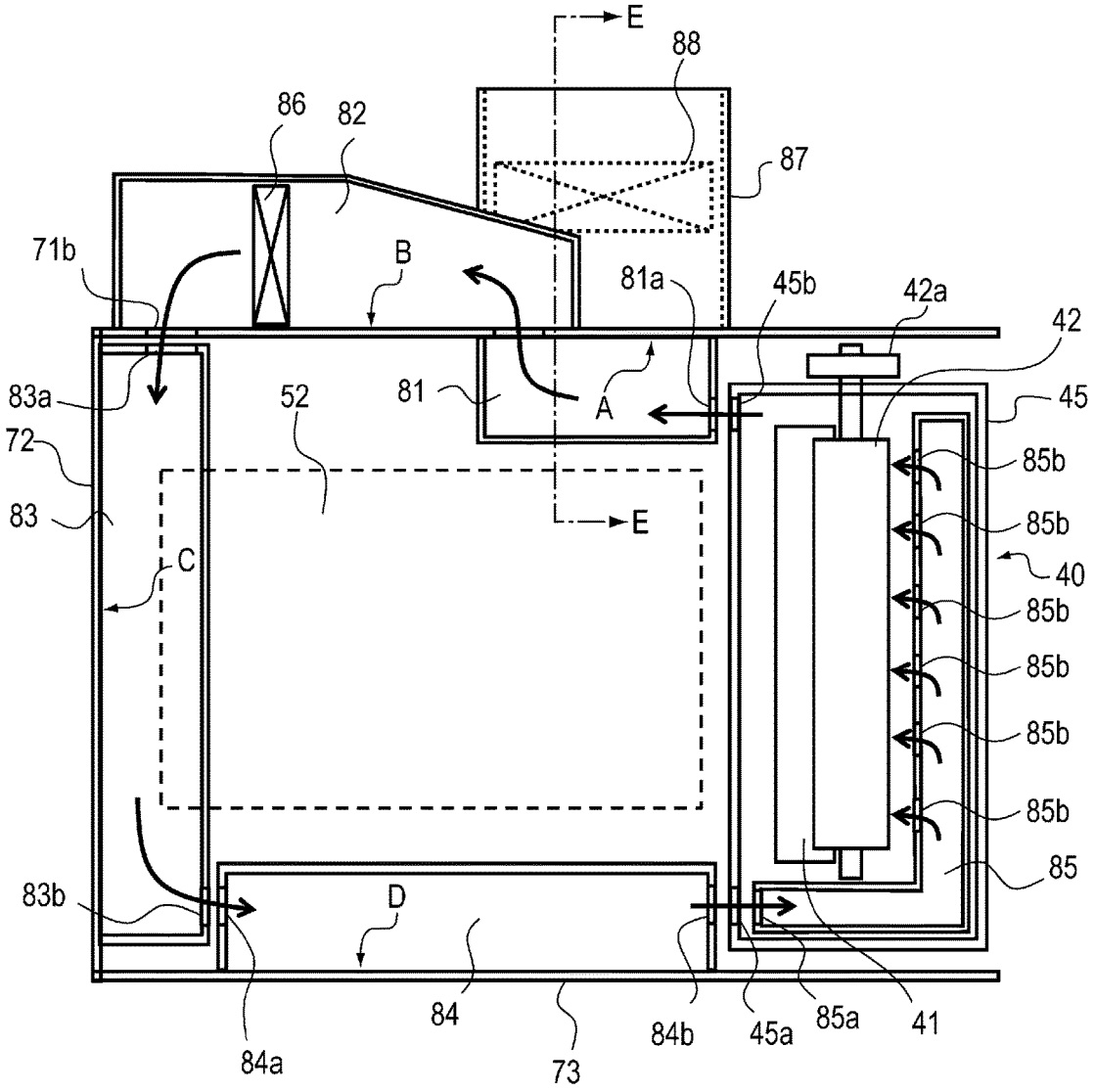
FIG. 3 is a horizontal sectional view of the image forming apparatus in the second embodiment.
Figure 4:
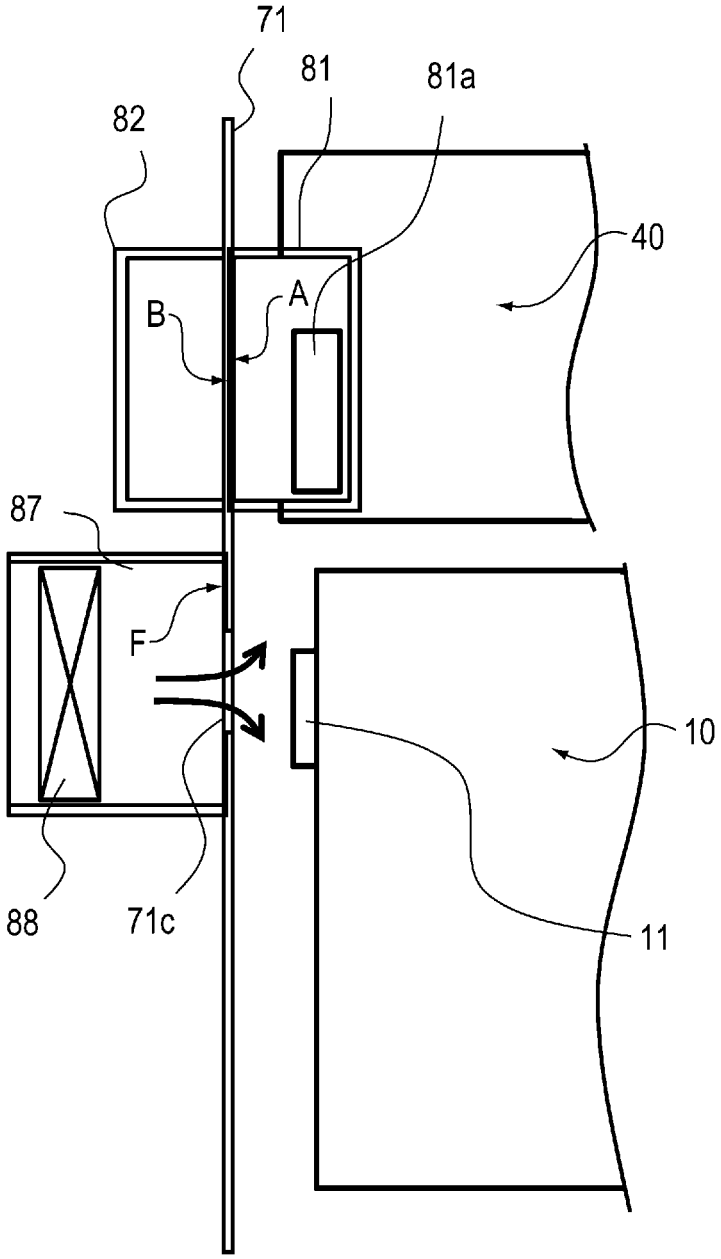
FIG. 4 is a schematic sectional view of a combination of the ducts 82 and 87, and its adjacencies, at a plane E-E in FIG. 3.

Next, referring to FIGS. 3 and 4, the second embodiment of the present invention is described. FIG. 3 is a horizontal sectional view of the image forming apparatus 100 in the second embodiment. For the sake of convenience, the discharge guide 44 and the pair of discharge rollers 51 are not illustrated in FIG. 3, as in the case of FIG. 2. Referring to FIG. 3, the essential characteristic feature of the image forming apparatus 100 in this embodiment is that the image forming apparatus 100 is provided with a combination of the sixth duct 87 and a cooling fan 88 for the cartridge, which is disposed directly below the second duct 82. FIG. 4 is a schematic sectional view of the sections of the image forming apparatus 100, which are related to this embodiment, at a plane E-E in FIG. 3. It shows the relationship among the sixth duct 87, cooling fan 88 for the cartridge 10, first duct 81, second duct 82, and cartridge 10.

Referring to FIG. 4, the sixth duct 87 is attached to the lateral plate 71 of the apparatus main assembly 100A so that it is disposed below the first and second ducts 81 and 82 which also are attached to the lateral plate 71 of the apparatus main assembly 100A. The cooling fan 88 for the cartridge 10 is disposed in the space surrounded by the sixth duct 87 and the lateral plate 71 of the apparatus main assembly 100A. The cooling fan 88, as cooling means, which hereafter may be referred to as the second fan, is provided for cooling the lateral plate 71 of the apparatus main assembly 100A. The cooling fan 88 draws the ambient air of the apparatus main assembly 100A into the sixth duct 87 to blow the drawn air at the lateral plate 71 of the apparatus main assembly 100A.

In terms of the vertical direction, the position of the sixth duct 87 is roughly the same as that of the photosensitive drum 11 in the cartridge 10. As the cooling fan 88 for the cartridge 10 is activated, the sixth duct 87 efficiently sends the ambient air to the photosensitive drum 11 through the hole 71*c* of the lateral plate 71 of the apparatus main assembly 100A, preventing thereby the photosensitive drum 11 from being increased in temperature by an image forming operation.

The image forming apparatus 100 is structured so that as the cooling fan 88 is activated, a part of the moving body of air generated by the cooling fan 88 to cool the cartridge 10 is blown at the surface F of the lateral plate 71 of the apparatus main assembly 100A. Therefore, the lateral plate 71 is reliably cooled. Therefore, it is ensured that as the body of air which contains a large amount of water vapor is drawn out of the fixing device 40, and moved through the first and second ducts 81 and 82, the water vapor in the body of air is made to condense on the surfaces A and B, respectively.

According to the second embodiment, while the body of hot air which contains a large amount of water vapor is drawn out of the fixing device 40, and is moved through the first and second ducts 81 and 82, by the air circulation fan 86, the water vapor in the body of air is made to condense by parts of the lateral plates of the apparatus main assembly 100A. Meanwhile the lateral plates of the apparatus main assembly 100A are continuously cooled by the cooling fan 88. Therefore, even if the air circulation fan 86 continuously draws hot air out of the fixing device 40, the cooling fan 88 prevents the lateral plate 71 of the apparatus main assembly 100A from increasing in temperature. Therefore, even when multiple sheets of humid recording medium are continuously conveyed through the fixing device 40, it is possible to keep the body of air in the fixing device 40 small in the amount of water vapor.

Embodiment 3

Figure 5:
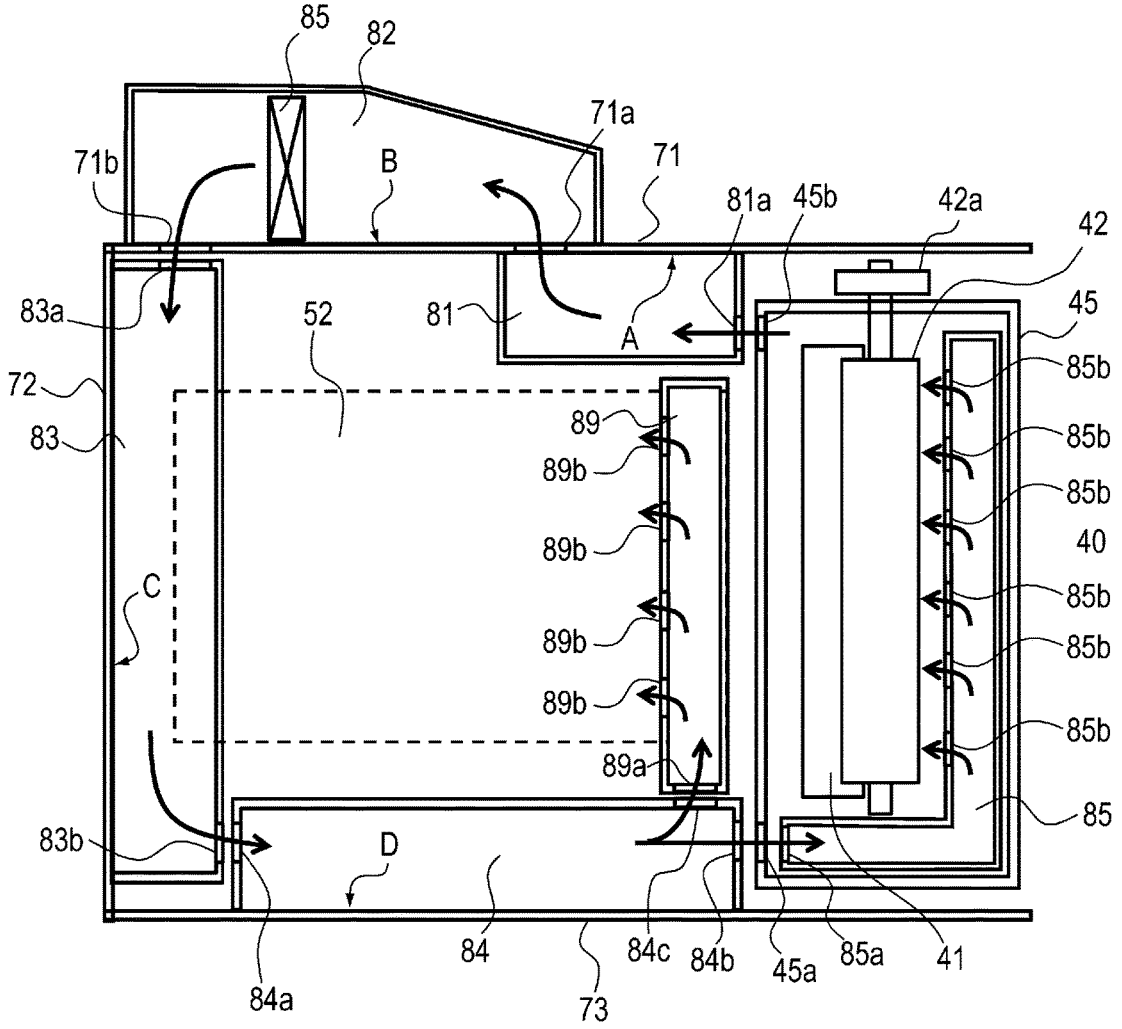
FIG. 5 is a horizontal sectional view of the image forming apparatus in the third embodiment of the present invention.

Next, referring to FIG. 5, the third embodiment of the present invention is described. FIG. 5 is a horizontal sectional view of the image forming apparatus 100 shown in FIG. 3. For the sake of convenience, FIG. 5 does not show the discharge guide 44 and the pair of discharge rollers 51, as in the case of FIG. 2. One of the characteristic features of the image forming apparatus 100 in this embodiment is that the fourth duct 84 is provided with an exhaust opening 84*c* in addition to the fourth exhaust opening 84*b*. The exhaust opening 84*c* faces the intake opening of the seventh duct 89.

The seventh duct 89 is provided with multiple exhaust openings 89*b*, each of which faces the delivery tray 52. According to this embodiment, after the body of air has been dehumidified by being moved through the first, second, third, and fourth ducts 81, 82, 83 and 84, respectively, a part of the body of air is diverted into the second duct 89, and then, is made to blow upon a sheet P of recording medium as the sheet P is discharged into the delivery tray 52. Thus, it is possible to reduce the surface temperature of the sheet P as soon as the sheet P comes out of the fixing device 40. Therefore, it is possible to prevent the phenomenon that as multiple prints (sheets of recording medium) are discharged one after another from the fixing device 40 into the delivery tray 52, in a manner to be layered in the tray 52, some of them become stuck to each other because of their high surface temperature.

According to the first to third embodiments, the body of air in the fixing device 40, which contains water vapor, can be drawn out of the fixing device 40, dehumidified, and then, sent back into the fixing device 40, making it possible to prevent the slippage which occurs between the fixation belt and pressure roller 42 because the water vapor condenses on the peripheral surface of the pressure roller 42. Therefore, it is possible to prevent the fixing device 40 from being jammed by sheets P of recording medium, and/or prevent the occurrence of image defects attributable to the slippage. In addition, it is possible to reduce an image forming apparatus in size and cost.

As described above, the third embodiment also can contribute to reduce an image forming apparatus in size and cost, like the first and second embodiments. Further, it can prevent the slippage which occurs in the fixing device 40. Therefore, it is possible to realize an image forming apparatus which does not suffer from the paper jam and/or image defect attributable to the slippage which occurs in the fixing device 40, and therefore, can output high quality images. Further, it is possible to prevent the problem that as two or more sheets P of recording medium are discharged one after another into the delivery tray, some of them stick to each other. Therefore, it is possible to provide an image forming apparatus which is higher in image quality.

By the way, in the first to third embodiments, the image forming apparatus 100 was provided with multiple ducts. However, these embodiments are not intended to limit the present invention in scope in terms of duct count. For example, adjacent ducts may be integrated. Further, it is in the second duct 83 that an air circulation fan 86 was disposed. However, these embodiments are not intended to limit the present invention in scope in terms of positioning of the air circulation fan. That is, it is needless to say that even if the air circulation fan is disposed in any of the other ducts, the same effects as those obtained by the first to third embodiments can be obtained.

Moreover, in the first to third embodiments, the image forming apparatus 100 was structured so that its lateral plate doubles as the metallic plate to be exposed in each duct. However, as long as a piece of metallic plate is exposed in each duct, it is not mandatory that the lateral plate of the apparatus main assembly 100A is made to double as the piece of metallic plate to be exposed in each duct. Further, a plate for catching the water drops which drip from the metallic plate in each duct as the water vapor in the body of air in each duct condenses on the metallic plate, and/or an absorbent component (which is desired to be piece of unwoven fabric or the like formed of chemical fiber or the like), is placed below the metallic plate exposed in each duct. That is, all that is necessary is that a piece of unwoven cloth, as water absorbing means, is placed within each of the first, second, third, and fourth ducts 81, 82, 83 and 84, and at (or slightly above) the bottom edge of each of the lateral plates 71, 72 and 73, of the apparatus main assembly 100A. With the employment of the above described structural arrangement, it does not occur that water drops fall within the image forming apparatus 100. That is, it is possible to efficiently remove the condensed water vapor.

According to the present invention, the body of air in the fixing section, which contains water vapor, can be drawn out of the fixing section, dehumidified, and then, sent back into the fixing section, without using desiccant.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-068368 filed on Mar. 30, 2015, which is hereby incorporated by reference herein in its entirety.

What is claimed is:

1. An image forming apparatus comprising:

a fixing portion configured to fix a toner image formed on a recording material thereon, said fixing portion including a heating member having a heat source, a pressing member cooperating with said heating member to form a nip while pressing against said heating member, and a frame containing said heating member and said pressing member;

a first opening provided in said frame and configured to permit air to flow from an inside of said frame to an outside of said frame;

a second opening provided in said frame and configured to permit air to flow from the outside of said frame to the inside of said frame; and an external duct provided outside said fixing portion and configured to guide the air discharged through said first opening to said second opening;

wherein at least a part of an inner wall of said external duct is made of a metal plate, and the air introduced through said second opening is guided to said pressing member.

2. An apparatus according to claim 1, wherein said first opening and said second opening are provided at longitudinally opposite end portions of said fixing portion, respectively, and said apparatus further comprises an internal duct provided inside said fixing portion and configured to blow the air introduced through said second opening to a surface of said pressing member over substantially an entire area of said pressing member with respect to the longitudinal direction.

3. An apparatus according to claim 1, further comprising a first fan provided in said external duct and configured to suck the air from the inside of said frame through said first opening.

4. An apparatus according to claim 1, further comprising a cooling device configured to cool said metal plate.

5. An apparatus according to claim 4, wherein said cooling device includes a second fan configured to suck ambient air from an outside of said apparatus and blow the ambient air to said metal plate.

6. An apparatus according to claim 1, wherein said metal plate is a part of a frame of said image forming apparatus.

7. An apparatus according to claim 1, further comprising a moisture absorbing device at or above a lower end of said metal plate inside said external duct.

8. An apparatus according to claim 7, wherein said moisture absorbing device includes nonwoven fabric.

* * * * *